United States Patent [19]

Willenbacher

[11] 4,112,859

[45] Sep. 12, 1978

[54] AUXILIARY SEWING MACHINE SUPPORT TABLE FOR USE WITH A SEWING MACHINE TABLE

[75] Inventor: Erich Willenbacher, Rheinstetten, Germany

[73] Assignee: Pfaff Industriemaschinen GmbH, Germany

[21] Appl. No.: 842,354

[22] Filed: Oct. 14, 1977

[30] Foreign Application Priority Data

Oct. 29, 1976 [DE] Fed. Rep. of Germany ... 7634272[U]

[51] Int. Cl.[2] ..... D05B 75/00

[52] U.S. Cl. ..... 112/217.1; 108/64

[58] Field of Search ..... 112/217.1, 217.2, 217.3, 112/217.4, 121.15; 312/194, 195, 196; 108/64, 65

[56] References Cited

U.S. PATENT DOCUMENTS

| | | | |
|---|---|---|---|
| 2,305,343 | 12/1942 | Gadbois | 112/217.1 |
| 2,483,106 | 9/1949 | Santley et al. | 112/217.1 |
| 4,004,527 | 1/1977 | Acker | 112/217.1 |

*Primary Examiner*—Henry S. Jaudon

*Attorney, Agent, or Firm*—McGlew and Tuttle

[57] ABSTRACT

An auxiliary sewing machine support table constructed for use with a sewing machine table having a sewing machine thereon with a reciprocating needle, with a surface which defines part of a means for feeding a workpiece in a feed direction. The auxiliary table is movable in a direction transverse to the feed direction and has a surface for carrying a remaining portion of the workpiece. The sewing machine table and the auxiliary table have trackway means defined therebetween which may be locked together by a clamping member carried on one of the tables which may be clamped to the other so as to lock a downwardly extending rail member on one table into an upwardly extending trackway on the other. The auxiliary table also includes controls for controlling the sewing machine from the auxiliary table.

8 Claims, 4 Drawing Figures

AUXILIARY SEWING MACHINE SUPPORT TABLE FOR USE WITH A SEWING MACHINE TABLE

FIELD AND BACKGROUND OF THE INVENTION

This invention relates in general to sewing machines and, in particular, to a new and useful sewing machine with a supplemental or auxiliary table coordinated with the table of the sewing machine frame and intended for the material being sewn which, in essence, is prepared on one side of a reference line going through the needle in a material feeding direction and fed to the point of stitch formation.

DESCRIPTION OF THE PRIOR ART

A design of auxiliary equipment for sewing tables which contributes to more economical production in the textile industry is known from German Utility Model Pat. No. 1,971,325. The auxiliary equipment consists of one or more parts in panel form which can be attached or moved to the sewing table and coupled to it. The panel-shaped parts serve to accommodate a supply of parts to be sewn. The arrangement of the panels in the proximity of the operator's seat which, as seen in the material feeding direction, is provided in front of the sewing machine, for the purpose of making it easier to accommodate and feed the parts to be sewn to the sewing machine. However, the panels do not form any continuation or enlargement of the bearing surface for the material as it is fed to the point of the stitch formation. For this reason, the auxiliary equipment is not suited for processing large area workpieces of different size, and also for the reason that large area workpieces are essentially supported and guided on the sewing table on one side of the needle, which automatically results in an operator's station sideways of the needle, but in the arrangement shown, this station is directly in front of the sewing machine and is laterally obstructed by the panels.

In order to process large area workpieces which, as already mentioned, are supported essentially on one side of the needle to sew a seam along their edge, it has already been suggested to coordinate a supplemental table with the sewing table in this support area, (German Utility Model Pat. No. 1,881,840). In this sewing machine design, the supplemental table is disposed so that it is laterally spaced from the sewing table and movable on guide rails parallel to the material feeding direction, or it can be driven in synchrony with the feeding means of the sewing machine. While this design facilitates the guiding of large area workpieces while being fed to the stitch-forming point, it makes the handling of the workpieces more difficult when sewing curved seams. In addition, this arrangement does not sufficiently take into account the processing of workpieces of different size.

SUMMARY OF THE INVENTION

It is an object of the invention to adapt the material bearing surface on the side of the needle facing the operator to cut parts of different size.

In accordance with the invention, this problem is solved in that the material support area of the supplemental table, disposed on the operator's side, is variable and this makes it possible for the operator to freely choose the support area size which best suits the shape and size of the workpieces.

Varying the support area of the supplemental table on the operator side fast and without trouble is made possible by a construction in which the supplemental table is steplessly movable relative to the sewing machine, essentially perpendicular to the material feeding direction and it can be connected and preferably locked to the table top of the sewing machine frame.

In order to always retain the same distance between the controls and the respective position of the operator in different positions of the supplemental table, the supplemental table is equipped with the controls to operate or drive the sewing machine and its ancillary equipment, rather than the sewing machine frame, as is common practice.

If possible, the sewing table and the supplemental table should not be separated completely in order to remove the supplemental table. It is advantageous, therefore, to provide the adjacent end edges of the sewing and supplemental tables with U-shape, mutually engaging guiding means each. The connection between sewing and supplemental tables is thus kept intact when the supplemental table is moved.

Accordingly, it is an object of the invention to provide an auxiliary sewing machine support table which has a table top for the partial support of a workpiece for use with a sewing machine with a table having a top for the remaining support of the workpiece which has a reciprocating needle and with the sewing machine edge extending transversely to the material feed direction to the needle and wherein the edge carries a first portion of an engagement rail and trackway which extends along the edge and comprising an auxiliary table having an edge extending parallel to the sewing table edge and having a complementary second portion of the engagement rail and trackway which is engageable with the first portion and, wherein, the auxiliary table is shiftable in a direction transverse to the feed direction with the second portion of the engagement rail and trackway engaged with the first portion.

A further object of the invention is to provide an auxiliary sewing machine support table for use with a sewing machine table which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
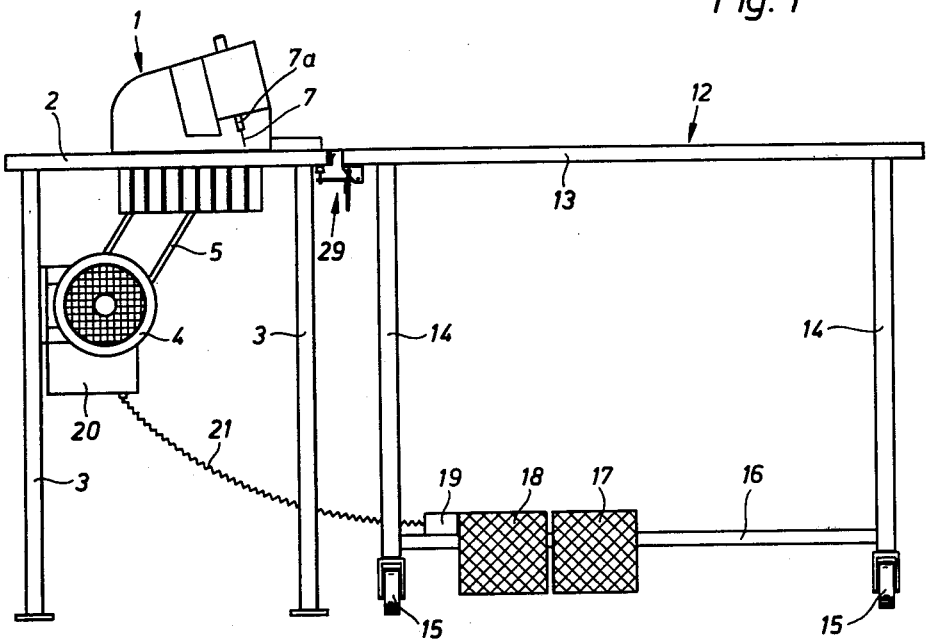
FIG. 1 is an elevational view of a sewing machine and a supplemental or auxiliary table for supporting a workpiece, constructed in accordance with the invention.

Referring to the drawings in particular, the invention embodied therein, comprises an auxiliary sewing machine support table or supplemental table 12 which is adapted to be used with a sewing machine table 2, each of which have top portions which provide support means for a portion of a workpiece 11. Workpiece 11 is advanced in a sewing direction, indicated by the arrow V, to a sewing station at which a needle 7 reciprocates along with its associated needle bar *7a*.

Sewing machine 1 is inserted in a cutout of the sewing table top 2 of a sewing machine table frame 3. The sewing machine 1 is driven by a motor 4 mounted to the sewing machine frame 3 and driving through a V-belt so that the needle 7, fastened to the needle bar *7a*, going up and down, forms a hem by means of grippers (not shown) on the edges 8, 9 and 10 of a workpiece 11, shown as an example. The workpiece 11 is moved by a known fabric mover (not shown) of sewing machine 1 in the direction of arrow V in FIG. 2. Workpiece 11 is appropriately turned on the sewing table at the respective seam end of the edges 8 and 9. The sewing machine 1 is stopped at the end of the seam on edge 10, and the threads are cut. A stacker may be used to remove the workpieces.

A supplemental table 12 is coordinated with the sewing table top 2 of frame 3. The surface of its table top 13 is a horizontal continuation of the fabric support surface of the sewing table top 2. Table top 13 has legs 14 equipped with casters 15 at their lower ends. Two foot pedals 17 and 18 and an electric junction box 19 are disposed on a stringer 16 connecting the table legs 14. The junction box 19 is connected to a switch box 20, coordinated with the motor 4, through a flexible coiled electric cord 21, which is variable in length. Coordinated with the foot pedals 17 and 18 are electric switches (not shown) for the control of the drive motor 4 and the ancillary equipment of the sewing machine 1 (thread cutter, pressure foot lifter and the like).

A rail 24 is screwed to the end edge 22 of the sewing table top 2 facing the supplemental table 12. Table edge 22, stop bar 23 and rail 24 form a track of roughly U-shape profile which is open towards the top. A track 26 of U-shape configuration which is open towards the bottom with legs 27 and 28 of different lengths is fastened to the end edge 25 of the table top 13 of the supplemental table 12 facing the sewing table 2. The short leg 27 of track 26 engages the track formed by the table edge 22, the stop bar 23 and the rail 24, which open towards the top.

To connect and preferably lock the supplemental table 12 to the table top 2 of the sewing machine frame 3, a clamping device 29 is provided, at least one of which is mounted to the underside of table top 13. The clamping device 29 comprises a mounting angle 30 which is fastened to the underside of the table top 13 and in which a clamping lever 31 is mounted so it can pivot about a pivot pin 32. A threaded pin 33 which supports a plastic or hard rubber pressure plate 34 at its free end is screwed into the free end of the clamping lever 31. A fork-shaped actuating lever 35 which pivota about a pivot pin 36 is also mounted to the mounting angle 30. Actuating lever 35 and clamping lever 31 are interconnected by a link 37, one end of which grips around the clamping lever 31 like a fork while the other end of link 37 projects into the fork-shaped part of the actuating lever 35 to which it is connected by a link pin 39. The web 40 of link 37 has a stop surface 41 to determine and limit the closed position of clamping and actuating lever 31 and 35, respectively.

It is mentioned that the operator's station is in front of the front edge 42 of the supplemental table 12. The control pedals 17 and 18 and the clamping device can be reached easily from there.

Figure 2:
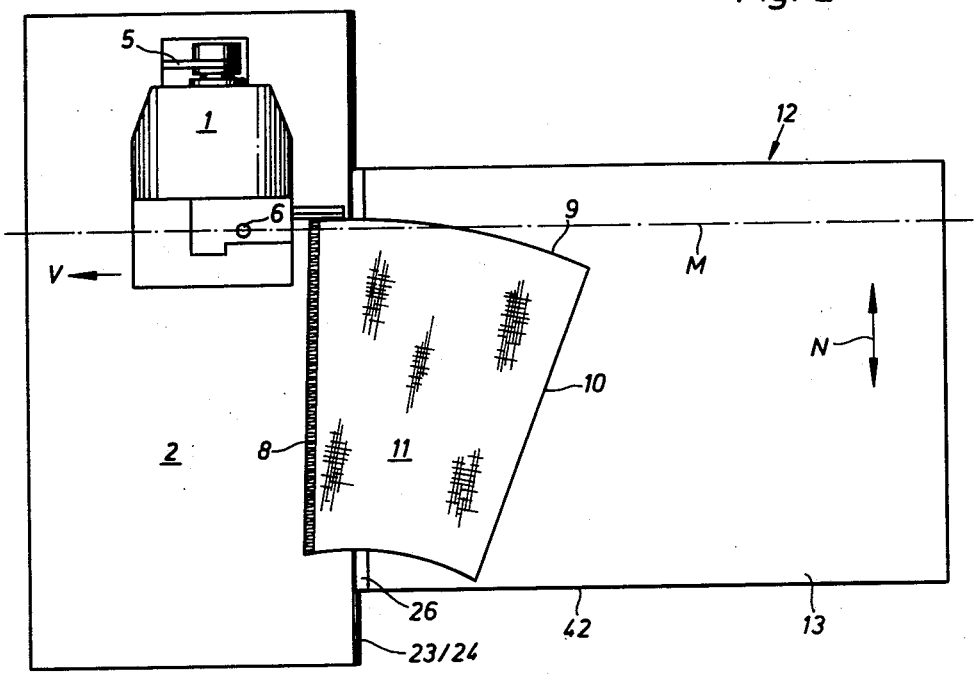
FIG. 2 is a top plan view of the device shown in FIG. 1.
Figure 3:
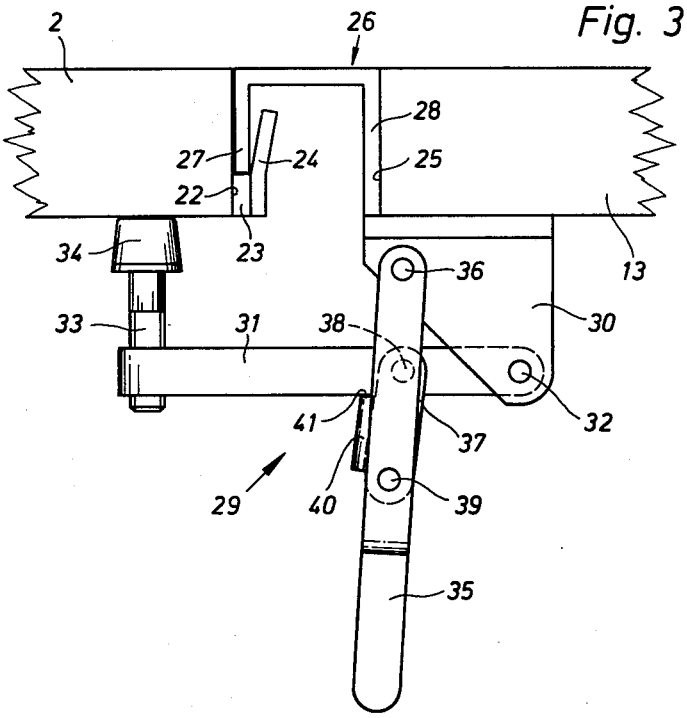
FIG. 3 is an enlarged partial elevational view of a clamping mechanism for clamping the rail and trackway connection between the auxiliary table and the sewing machine table.
Figure 4:
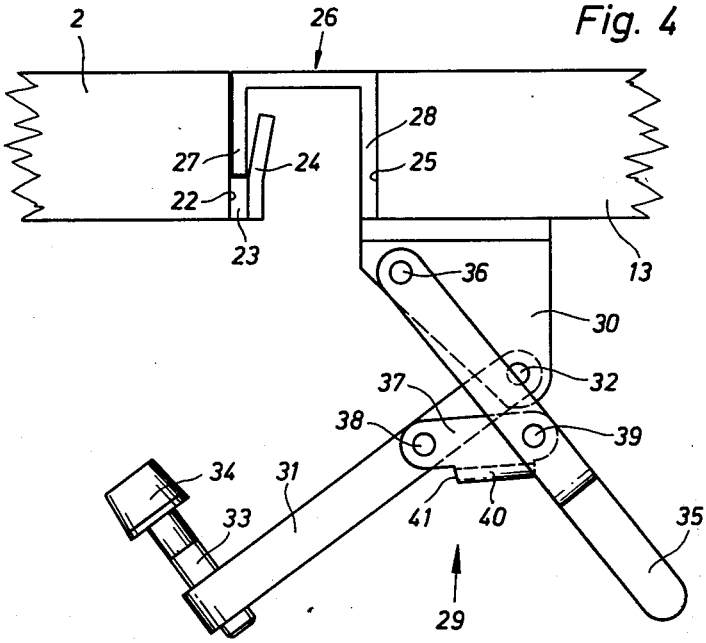
FIG. 4 is a view similar to FIG. 3 showing the clamping mechanism in an unclamped position.

When the clamping device 29 (FIG. 4) is open, the supplemental table 12 can be moved by the operator perpendicular to a reference line M going through the needle 7 in a fabric feeding direction (arrow V in FIG. 2) in the directions characterized by the double arrow N in FIG. 2. This makes it possible to adapt the material support area of the supplemental table 12 in a simple manner to the respective size of the workpieces to be processed between the reference line M and the front edge 42, thereby assuring convenient handling of the material being sewn. The clamping device 29 is closed in the desired position of supplemental table 12 by pivoting the actuating lever 35 about the pivot pin 36, by which motion, the knuckle joint formed by the link 37 and the actuating lever 35, articulated at 36, 38 and 39, is moved a short distance through its extended position into a folded position, according to FIG. 3, in which the leg 27 of track 26 is pushed against the stop bar 23 and the pressure plate 34 is pushed against the underside of the sewing table top 2. In this position of the clamping device 29, the sewing table and the supplemental table (2 and 12) are locked together both safely and securely. Mounting the control pedals 17 and 18 on the supplemental table 12 has the advantage that the pedals can be reached equally well by the operator in any position of the supplemental table.

While a specific embodiment of the invention has been shown and described in detail to illustrate the application of the principles of the invention, it will be understood that the invention may be embodied otherwise without departing from such principles.

What is claimed is:

1. An auxiliary support table for use with a sewing machine table with a sewing machine which has a reciprocating needle, and which has a table top for supporting a part of the workpiece with a sewing table edge extending transversely of the material feed direction to the needle and also having a first portion of an engagement rail trackway extending along the edge, comprising an auxiliary table having an edge extending substantially parallel to the sewing table edge and having a complementary second portion of the engagement rail and trackway which is engageable with the first portion of the engagement rail and trackway, said auxiliary table being shiftable in the direction transverse to the feed direction relative to the sewing machine table with said second portion in engagement with the first portion on the sewing machine support table.

2. An auxiliary support table, according to claim 1, wherein said auxiliary table includes means for supporting said table for movement substantially perpendicular to the feed direction and including clamping means on said auxiliary table for clamping said first and second portions together.

3. An auxiliary support table, according to claim 1, including a sewing machine table having the sewing machine thereon, a motor connected to said sewing machine to drive said sewing machine, sewing machine operating controls carried on said auxiliary table and an electrical connection cable from said control to said motor means for driving said sewing machine.

4. An auxiliary support table, according to claim 3, including an open top receiving trackway defined along the sewing machine table edge and a rail carried by said auxiliary table edge engageable into the open top trackway and a clamp carried on said auxiliary table being movable into engagement with said sewing machine table to urge said sewing machine table trackway into tight engagement with said rail on said auxiliary table.

5. An auxiliary support table, according to claim 4, including a U-shape member carried along the edge of said auxiliary table having an outer downwardly extending leg portion forming a rail, said sewing machine having a complementary rail member extending along said edge of said sewing machine table, said sewing machine table also having a rail-like member extending upwardly exteriorly of said rail along said edge to define a receiving trackway.

6. A combined sewing machine table and supplementary table, comprising a table top having a sewing machine thereon, a needle reciprocating on said table top on a sewing machine station and defining an area for the feeding of material toward the needle in a feeding direction, said table having an edge perpendicular to the feeding direction, an auxiliary table having a table top for holding a portion of the material to be sewn having an edge extending substantially parallel to said sewing machine table edge and rail and track means carried along the edges of said sewing machine table and said auxiliary table which are interengageable and permit relative movement of said auxiliary table and said sewing machine table.

7. A combined sewing machine table and supplementary table, according to claim 6, including caster means carried on said auxiliary table for the movement of said table.

8. A combined sewing machine table and supplementary table, according to claim 6, including a motor carried on said sewing machine table driving said sewing machine and control means carried on said auxiliary table connected to said motor by flexible connection means permitting control of said sewing machine from said auxiliary table.

* * * * *